United States Patent [19]

Boyle

[11] Patent Number: 4,763,499

[45] Date of Patent: Aug. 16, 1988

[54] DOOR SECURITY SYSTEM

[76] Inventor: John J. Boyle, 5895 SW. 35 St., Miami, Fla. 33155

[21] Appl. No.: 35,591

[22] Filed: Apr. 7, 1987

[51] Int. Cl.[4] ..... E05B 63/00

[52] U.S. Cl. ..... 70/417; 70/418; 70/451; 70/452

[58] Field of Search ..... 70/452, 451, 448, 417, 70/418, 416; 292/346; 16/221, 380

[56] References Cited

U.S. PATENT DOCUMENTS

| | | | |
|---|---|---|---|
| 3,828,476 | 8/1974 | Tenenbaum | 16/221 |
| 4,116,514 | 9/1978 | Lawrence | 16/380 |
| 4,139,999 | 2/1979 | Allenbaugh | 70/452 |
| 4,175,315 | 11/1979 | Hayes | 16/380 |
| 4,570,467 | 2/1986 | Greco | 70/452 |

*Primary Examiner*—Robert L. Wolfe
*Attorney, Agent, or Firm*—John Cyril Malloy

[57] ABSTRACT

A door security system for the protection of a lock as well as a set of hinges both associated with a door wherein the security system includes a wrap-around cover plate covering surface portions of the exterior and interior of the door adjacent the lock and the lock side surface around the bolt plate of the lock. In addition, structures designed to protect each of the plurality of hinges serving to hang the door on the hinge jamb thereof include a wrap-around cover plate and hinge pin fittings on the inside of the door and a jamb plate and a vertical bar attached to an exterior section which includes a bar surface that is adjacent to a vertically extensive, exterior surface end region of the hinge cover plate when the door is closed.

24 Claims, 5 Drawing Sheets

DOOR SECURITY SYSTEM

BACKGROUND OF THE INVENTION

The present invention relates to a door security system and particularly relates to a dead bolt lock reinforcement assembly, a reinforced strike plate, and a reinforced door hinge assembly.

One prior art device is simply a cover plate that wraps around the door adjacent the exterior and interior lock portions. The cover plate is made of thin metal and includes an exterior plate-section, a lock-side section, and an interior plate-section. A portion of the interior and exterior plate-sections are disposed underneath the interior and exterior lock portions such that these lock portions extend normal to the surface plane of the plate-sections and hence the door surface.

Based upon actual field experiences, this prior art device did not prevent a person from smashing the exterior portion of the lock, thereby destroying the lock, and gaining entry into a dwelling. Further, the prior art system did not prevent a person from smashing the "solid core" door to such degree that the door body itself breaks apart. Also the prior art system allowed the lock strike plate, on the lock-side door jamb, to be knocked out of the door jamb or angled to such a degree that the dead bolt slips out of the strike plate thereby enabling entry into the dwelling. Several other disadvantages of this prior art system and advantages of the present invention are discussed later with respect to the present invention.

OBJECTS OF THE INVENTION

It is an object of the present invention to provide a door security system which limits access to the exterior portion of a dead bolt door lock other than by a key.

It is another object of the present invention to provide a reinforced strike plate.

It is a further object of the present invention to provide a hinge assembly that is substantially more secure than commonly available hinges.

It is another object of the present invention to provide a door security system which limits the ability of a person from breaking down the door due to angle iron-shaped arms extending from a cover plate.

It is an object of the present invention to protect the dead bolt lock and the adjacent portions of the door with a cover plate that wraps around the portions of the door proximate the interior, the lock-side and exterior surfaces.

It is an additional object of the present invention to provide a vertical bar protruding from the strike plate surface to limit access to the interface between the door and the strike plate.

It is another object of the present invention to provide a vertical bar protruding from the jamb hinge subassembly to limit access to the interface between the door and the hinge-side jamb.

It is a further object of the present invention to provide respective rods extending normal to the strike plate and normal to the jamb hinge subassembly, parallel to and away from the exterior door surface, and extending into the dwelling structure behind each respective jamb, such that the hinges and the strike plate cannot be mutilated, forced into misalignment, angularly displaced or destroyed by a person seeking entry into the dwelling.

SUMMARY OF THE INVENTION

The door security system, in one embodiment, protects a dead bolt lock on a door, a lock strike plate affixed to a lock-side door jamb, and a set of hinges on the hinge-side door jamb. A wraparound cover plate covers surface portions of the exterior and interior side door surfaces adjacent the lock plus the lock-side surface of the door adjacent the bolt plate of the lock. Angle iron-shaped members extend as arms from the upper and lower exterior and interior cover plate surfaces substantially horizontally across the door. The upper and lower protruding member segments, of the angle iron-shaped members, face each other. A cylindrical collar for the lock circumferentially surrounds the exterior portion of the lock and extends from the exterior cover plate-section intermediate the corresponding upper and lower protruding member segments.

A reinforced strike plate is mounted flush on the lock-side door jamb and includes two vertical bars, one is a stop bar for the door, and the other is spaced therefrom and has an exterior bar surface substantially coplanar with the extensive protruding edges of the upper and lower arms mounted on the exterior of the door.

Three hinge assemblies hang the door to the hinge-side door jamb. Each hinge assembly includes a door hinge subassembly and a jamb hinge subassembly. The hinge subassembly includes a wraparound cover plate and hinge pin fittings on the inside of the door. The jamb hinge subassembly includes a jamb plate having an exterior plate-section, normal to the exterior surface plane of the closed door, and an interior plate-section coplanar to the exterior section. A vertical bar is attached to the exterior section and includes a bar surface that is adjacent to a vertically extensive, exterior surface end region of the hinge subassembly cover plate when the door is closed. The jamb plate also includes pin fittings which interleave with the pin fittings on the door hinge subassembly such that a hinge pin extends through the interleaved pin fittings, thereby hanging the door.

BRIEF DESCRIPTION OF THE DRAWINGS

Further objects and advantages of the present invention may be found in the detailed description of the preferred embodiments when taken in conjunction with the accompanying drawings in which.

DETAILED DESCRIPTION OF THE PREFERRED EMBODIMENT

The present invention relates to a door security system that is made of a lock security assembly, a reinforced strike plate, and a door hinge assembly.

Figure 1:
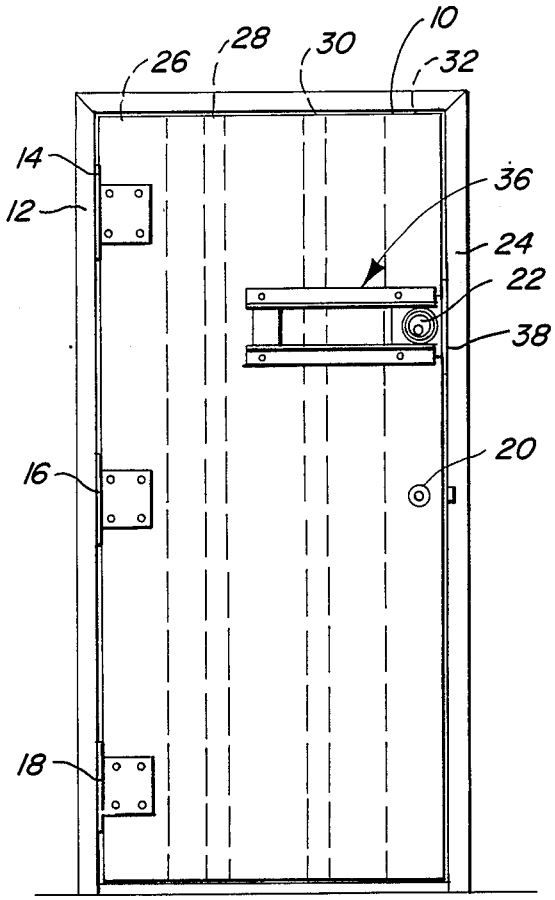
FIG. 1 is a plan view of a door with the security system installed as viewed from a position outside the dwelling.

FIG. 1 illustrates a plan view of the security system from a perspective exterior to door 10, i.e., from a position outside a dwelling looking towards closed door 10. The door is hung on a hinge-side door jamb 12 by hinge assemblies 14, 16 and 18. Door 10 can be locked, unlocked and opened dependent upon the operative condition of a common door handle and lock combination 20, and dead bolt lock 22. The bolts from locks 20 and 22 protrude into appropriate strike plates on lock-side door jamb 24.

In one working embodiment, the security system is installed on a "solid core" wooden door. Such a door is illustrated in FIG. 1. However, the "solid core" door is not customarily made of solid wood, but rather includes a plurality of solid wood studs or stringers 26, 28, 30 and 32, to which are glued exterior and interior wood door surface sheets. The interspace between door studs 26, 28, 30 and 32 is filled with wooden and miscellaneous particulate matter.

Figure 2:
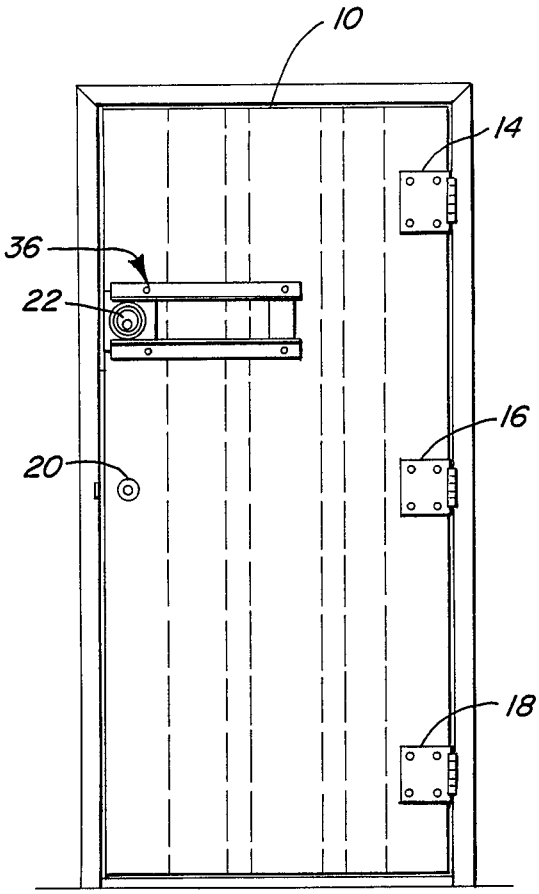
FIG. 2 is a plan view of the door security system as viewed from a position inside the dwelling.

FIG. 2, wherein like numerals designate like items, illustrates door 10 from the interior of the dwelling.

Dead bolt lock security assembly 36 generally protects dead bolt lock 22 as well as limits the ability of a person to knock down door 10 because of the length of the arms of lock security assembly 36. Those arms, described in detail later, extend about the width of door 10. Reinforced strike plate 38 limits access to lock security assembly 36 and further limits the access to the strike plate into which protrudes the dead bolt from lock 22 when the door is locked. Door hinge assemblies 14, 16 and 18 limit access to the hinge-side door surface, such that a person outside the dwelling cannot pry the hinges off the door.

Figure 3:
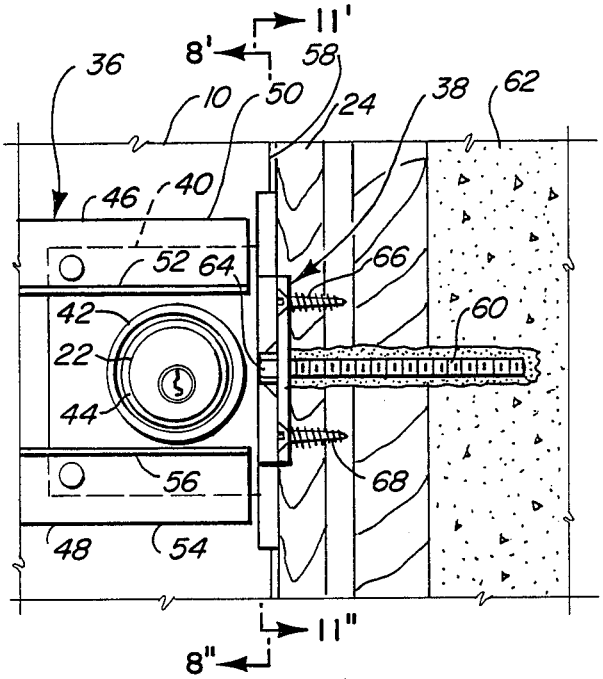
FIG. 3 is a detailed view of the strike plate mounted to the lock-side door jamb, and the dead bolt lock, and the exterior portions of the security system with the door closed.

FIG. 3 illustrates the detailed view of the lock security assembly 36, the reinforce strike plate 38 and portions of door 10 and a cross-sectional view of lock-side door jamb 24.

Lock security assembly 36 protects dead bolt lock 22. Assembly 36 includes a cover plate that wraps around the door. FIG. 3 shows the exterior plate-section 40 of the wraparound cover plate. Attached to plate-section 40 is a cylindrical collar 42 that circumferentially surrounds an exterior lock portion 44 of lock 22. Attached to the upper and lower plate-section surfaces are angle iron-shaped members 46 and 48, respectively. Angle iron-shaped member 46 has a member segment 50 parallel to but spaced from the exterior door surface and a protruding member segment 52 that extends normal to the exterior door surface. Likewise, angle iron-shaped member 48 includes parallel member segment 54 and protruding member segment 56. Member segments 50 and 54 are coplanar and are affixed to plate-section 40. The upper and lower protruding member segments 52 and 56 face each other and cylindrical collar 42 is intermediate these member segments. Therefore, the person outside the dwelling is confronted with several structures protecting lock 22.

Reinforced strike plate 38 is described in detail later with respect to FIG. 11, however certain details of strike plate 38 are well shown in FIG. 3. Door 10 includes lock-side door surface 58. The dead bolt from lock 22 extends normal to this lock-side door surface and into strike plate 38. Attached to strike plate 38 is rod 60. Rod 60 extends from the strike plate normal to lock-side door surface 58, parallel to the exterior door surface and in a direction away from surface 58. Therefore, rod 60 extends into the structural components that make up door jamb 24. Most importantly, rod 60 extends well into a concrete wall section 62 and is firmly anchored therein. To mount strike plate 38 to the jamb, a hole is drilled in the jamb, rod 60 is inserted by threading the rod on nut 64 that is attached to the strike plate. After rod 60 is installed into door jamb 24 and particularly fixed by glue or cement into cement section 62 of the jamb, nut 64 and rod 60 are welded together onto strike plate 38. With or without the rod as a security fixture, strike plate 38 is mounted to jamb 24 by, in this embodiment, wood screws 66 and 68 that extend into the wooden portion of jamb 24.

Figure 4:
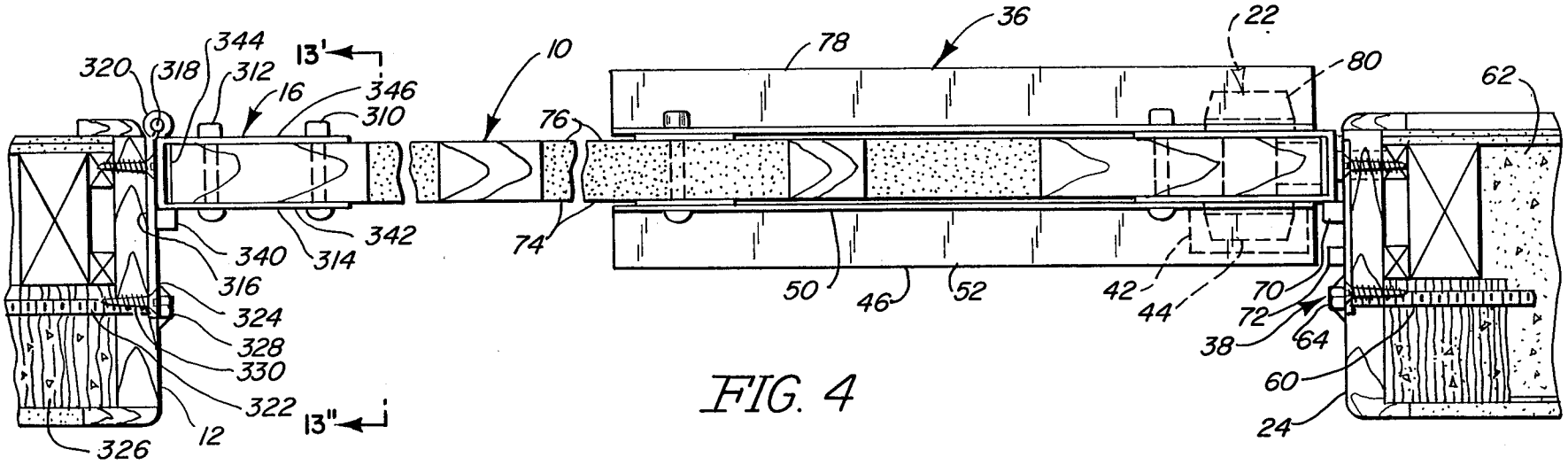
FIG. 4 illustrates a broken-away, cross-sectional top view of the door, the lock-side door jamb, the hinge-side door jamb and the extensive arms of the security system when the door is closed.

FIG. 4 illustrates a cross-sectional, broken-away view of the door security system. Rod 60 of reinforced strike plate 38 is shown extending into concrete wall section 62. Strike plate 38 includes two vertical bars 70 and 72 that will be explained later in detail.

Lock security assembly 36 includes two angle iron-shaped members on each side of the door, on exterior door surface 74 and on interior door surface 76 of door 10. Therefore, angle iron-shaped member 78, on interior surface 76, is complementary to and oppositely disposed with respect to member 46 on exterior door surface 74. FIG. 4 shows exterior lock portion 44 protected by cylindrical collar 42. Lock 22 also includes interior lock section 80 protruding normal to interior door surface 76.

Door hinge assembly 16, shown on the left-side of FIG. 4, will be described in detail later and particularly with respect to FIGS. 13 and 14.

Figure 5:
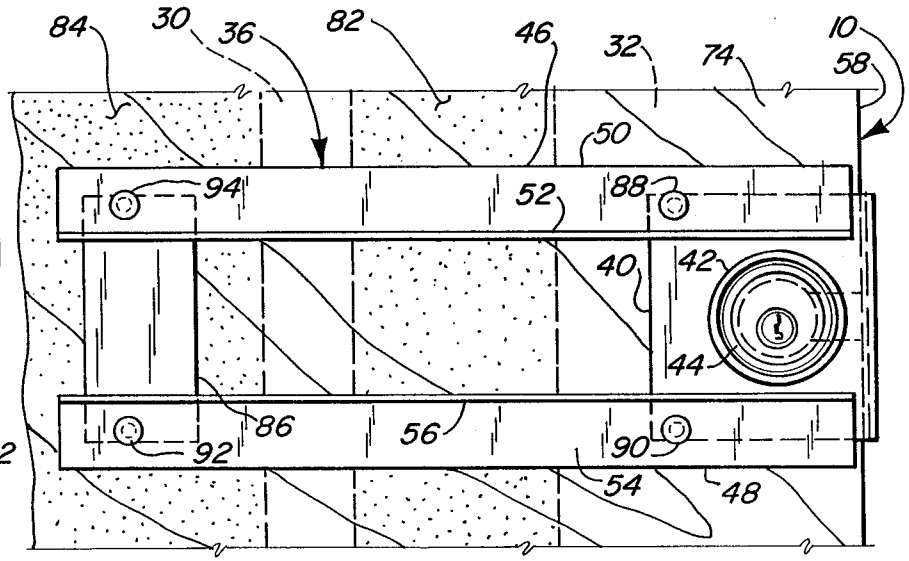
FIG. 5 illustrates a detailed view of the lock security system from the exterior of the door.

FIG. 5 is a detailed view of lock security assembly 36. FIG. 5 shows that door 10 includes a wooden exterior door surface 74 and an inside construction including studs 32 and 30 with particulate matter 82 and 84 in the interspace between studs 32 and 30.

Generally, the exterior portion of lock security assembly 36 is a mirror image of the interior portion of that assembly except for cylindrical collar 42 that circumferentially surrounds exterior lock portion 44. Likewise the upper components of assembly 36 are a mirror image of the lower components. Coplanar member segments 50 and 54 of the angle iron-shaped members are spaced from exterior door surface 74 due to the thickness of exterior plate-section 40. To ensure that the members do not bow, a joiner plate 86 is attached to the other longitudinal end of each member. In this embodiment, all the components of the security system are metal. Therefore, the inside of member segment 50 is welded to the outside of exterior plate-section 40 at one longitudinal end of member segment 60. At the other longitudinal end of member segment 50, joiner plate 86 is welded. The thickness of joiner plate 86 equals the thickness of exterior plate-section 40, as generally shown in FIG. 4.

The lock security assembly 36 is mounted to door 10 by four bolts extending through bolt holes 88, 90, 92 and 94. In the working embodiment, it does not seem significant that bolts mounting the distal ends of members 46 and 48 that are like arms from exterior plate-section 40, extend through wooden stud or strut 30 in the inside of the door. However, it is important that the arms or members 46 and 48, extending from plate-section 40, do extend at least half and preferably two-thirds of the width of the door from its lock-side surface to its hinge-side surface.

Figure 6:
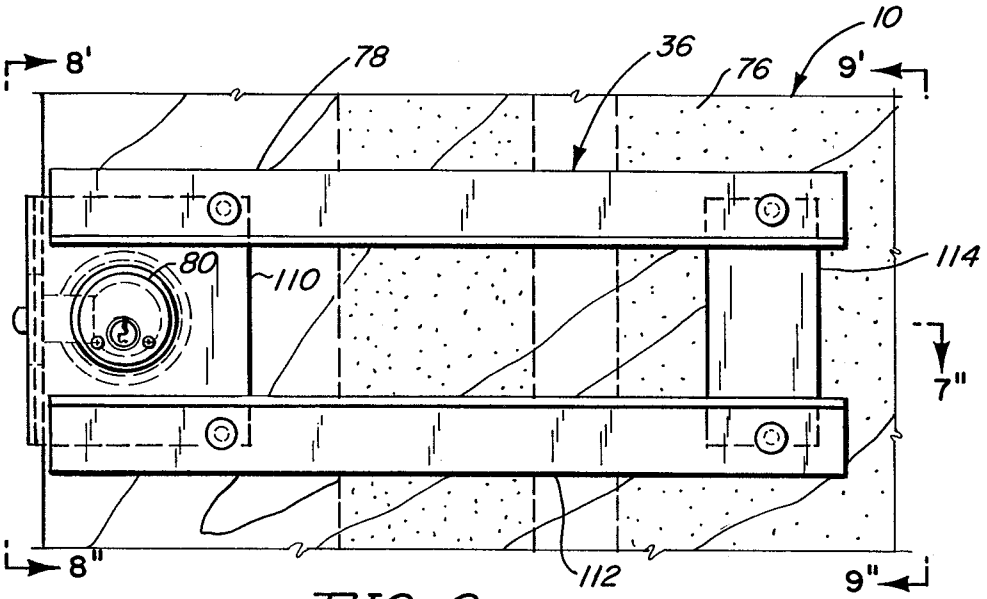
FIG. 6 illustrates a detailed view of the lock security system with the dead bolt extended, as viewed from a perspective inside the dwelling, i.e., interior to the door.

FIG. 6 illustrates lock security assembly 36 from the perspective of a position interior to the dwelling. FIG. 6 shows the interior plate-section 110 of the cover plate. Interior plate-section 110 covers the interior door surface adjacent interior lock portion 80. Angle iron-shaped members 78 and 112 extend like arms from interior plate-section 110. Members 78 and 110 extend horizontally across the door. One longitudinal end surface region of members 78 and 112 are welded to interior plate-section 110. The other longitudinal end surface regions of members 78 and 112 are welded to an interior joining plate 114.

Figure 7:
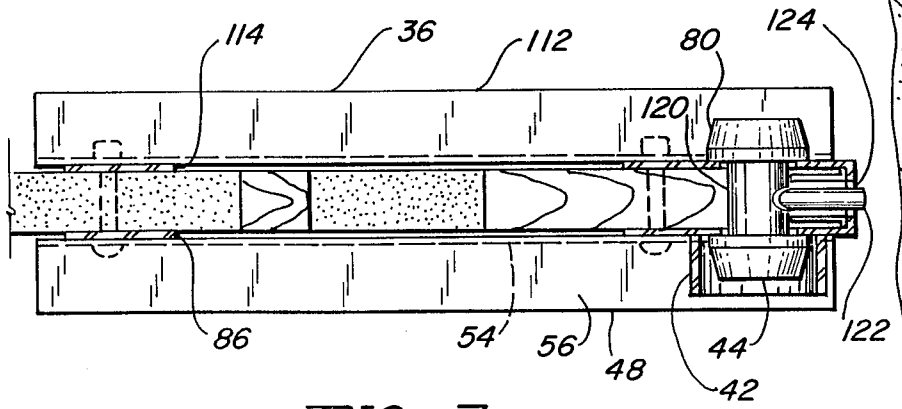
FIG. 7 illustrates, in cross section, a top plan view of security lock system from the perspective of section line 7'-7" in FIG. 6.

FIG. 7 is a detailed, cross-sectional plan view of lock security assembly 36 from the perspective of section line 7'-7" in FIG. 6. Exterior and interior lock portions 44 and 80 are joined by lock cylinder 120 that extends through the exterior and interior plate-sections as well as through door 10. Dead bolt 122 protrudes from bolt plate 124 of the lock.

Figure 8:
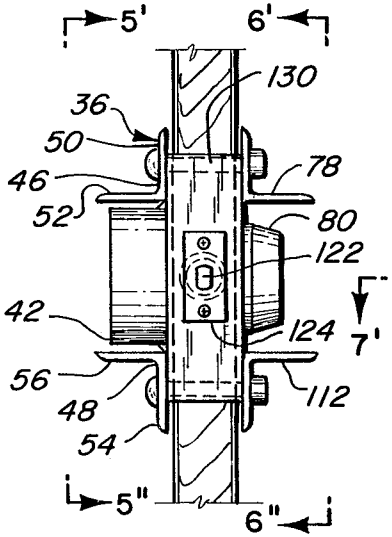
FIG. 8 illustrates the lock security system from the perspective of section line 8'-8" in FIG. 6, i.e., a side view of the lock-side door surface.

FIG. 8 illustrates a lock-door side in view of lock security assembly 36. FIG. 8 is a view from the perspective of section lines 8'-8" in FIG. 6. The wraparound cover plate includes lock-side plate-section 130 that is integral with exterior plate-section 40 (FIG. 5) and interior plate-section 110 (FIG. 6). Bolt plate 124 is mounted flush with respect to plate-section 130.

The angle iron-shape of members 46, 48, 78 and 112 are clearly illustrated in FIG. 8. Further, the interior-/exterior mirror image of the lock security assembly 36 is shown in that Figure except for collar 42 extending from the exterior plate-section.

Figure 9:
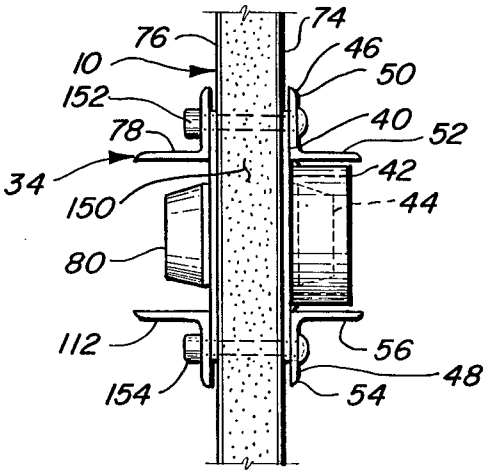
FIG. 9 illustrates a cross-sectional view of the lock security system from the perspective of section line 9'-9" in FIG. 6.

FIG. 9 illustrates a view of the lock security system from the perspective of section line 9'9" in FIG. 6. FIG. 9 particularly shows double-walled wooden surfaces 74 and 76 of door 10. Also, particulate matter 150 in the interspace between those double-walled surfaces. Through bolts 152 and 154 provide a mounting means for lock security system 34 onto door 10.

Figure 10:
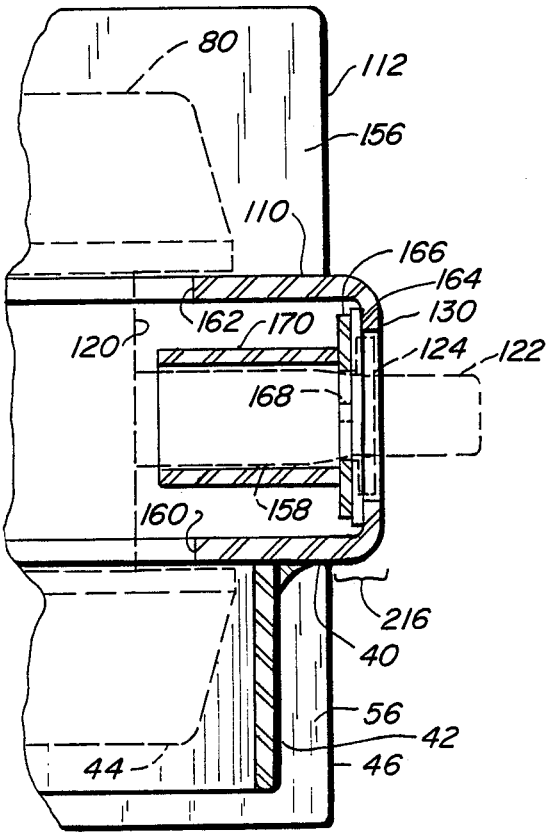
FIG. 10 illustrates a detailed, cross-sectional top view of the lock security system particularly around the dead bolt.

FIG. 10 shows a detailed, cross-sectional top view of the lock security system particularly showing the lock-side portion of the system. Angle iron-shaped member 46 and collar 42 protect exterior lock portion 44. Lock portion 44, in dashed lines, is joined to interior lock portion 80 by lock mechanism 120. Interior lock portion 80 is protected by angle iron-shaped member 122 and particularly the normally protruding member section 156 is shown in FIG. 10. Extending substantially intermediate between the interior and exterior door surfaces, is bolt cylinder 158. Bolt plate 124 and dead bolt 122, as well as the balance of the lock, is shown in dashed outline in FIG. 10.

The cover plate, as discussed earlier, includes exterior plate-section 40, lock-side plate-section 30 and interior plate-section 110. Therefore, the cover plate wraps around the door. Lock mechanism 120 extends through a circular cut-out 160, in plate-section 140 and cut-out 162 in plate-section 110, as well as through the door.

Bolt plate 124 is mounted flush with respect to plate-section 130. This is accomplished by spacer 164 and secondary backing plate 166. Secondary plate 166, spacer 164 and plate-section 130 are welded together since all of these components are made of metal. Bolt plate 124 is considered part of the lock and is attached to bolt cylinder 158. Bolt plate 124, as well as the connected portions of the lock, are attached to the door by screws that pass through screw holes, one of which is screw hole 168 that is below dead bolt 122. The other screw hole is above that bolt. FIG. 8 shows these upper and lower screw holes. Attached to secondary plate 166 is a bolt cylinder collar 170. Bolt cylinder 158 closely fits within cylinder collar 170. The cylinder collar is welded to secondary plate 166. The purpose bolt cylinder collar 170 is to prevent the person from "bending" or angularly displacing the bolt cylinder when excessive force is applied to the door or to the lock security system during an attempted entry into the dwelling.

Specifically, the purpose of lock security assembly 36 is to limit the access to exterior lock portion 44 from a person seeking entry into the dwelling without a key. The radial spacing between exterior lock portion 44 and collar 42 is based upon the size of the lock and the difficulty a person would have in inserting a key on a key ring, carrying a plurality of keys, and turning the key in the lock. Ideally, the extensive, protruding end surface of exterior lock portion 44 is about two-thirds of the distance of the entire protrusion of lock collar 42 from plate-section 40. The spacing between collar 42 and upper and lower protruding member sections 52 and 56 is small. However, those components are spaced apart such that a person seeking entry would not be able to "bend" or angularly displace those upper and lower protruding member sections enough to affect the protection provided by collar 42.

The arms extending from exterior plate-section 40 and interior plate-section 110, defined by the upper and lower angle iron-shaped members 46, 48, 78 and 112, strengthen the integrity of the lock security system. Joining plates 86 and 114 (FIGS. 5 and 6) ensure that the distal longitudinal ends of the members are not bent, thereby affecting the security of the dead bolt lock. As shown in FIG. 10, exterior lock portion 44 and interior lock portion 80 are set on circumferential regions of exterior plate-section 40 and interior plate-section 110, respectively. Therefore, the wraparound cover plate effectively mounts the outer or outside protruding portions of the lock. The term "outside" refers to items outboard of the door's structural interior. Therefore, the term "inside" refers to items that are facing inboard towards the interior structural components of the door, for example the door studs. Specifically, bolt cylinder collar 170 extends from the inside surface of secondary plate 166. However, lock portion 44 and lock portion 80 extends from the outside surface of plate-section 40 and plate-section 110, respectively. The term "exterior" refers to items outside the dwelling and the term "interior" refers to items inside the dwelling, based upon the assumption that door 10 is closed.

In a preferred embodiment, the security system includes lock security assembly 36, reinforced strike plate 38, and a plurality of door hinge assemblies 14, 16 and 18. However, it is not absolutely essential that the security system be made of all three assemblies (assembly 36, strike plate 38 and door hinge assemblies 14, 16 and 18). It is possible that the utilization of lock security system 36 may be sufficient for protecting the lock on the door. However by simply protecting the dead bolt lock, a person seeking entry without a key could break the strike plate normally placed on the lock-side door jamb 24 or destroy the hinges.

Figure 11:
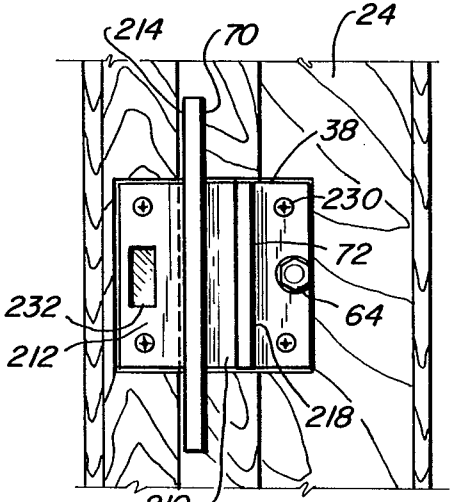
FIG. 11 illustrates a front view of the reinforced strike plate and lock-side door jamb.

FIG. 11 shows a side view of reinforced strike plate 38. Strike plate 38 is flush with the jamb 24, extends through the exterior surface plane of the door, and specifically includes exterior plate-section 210 and interior platesection 212. When the door is closed, vertically extensive bar 70 is a door stop therefore it is generally near the interface between plate-section 210 and plate-section 212. Vertical bar 70 includes a bar surface 214 that is normal to strike plate 38. Bar surface 214 is adjacent a vertically extensive, exterior end surface section of the cover plate and particularly of exterior plate-section 40. This exterior end surface section of plate-section 40 is shown as end surface section 216 in FIG. 10. Therefore, vertical bar 70 mates with plate-section 40 and does not touch the longitudinal edges of angle iron-shaped members 46 and 48. Further, the vertical extent of bar 70 exceeds the vertical extent of members 46 and 48, thereby protecting the upper and lower coplanar edges of those members. Spaced from vertical bar 70 on the exterior plate-section 210 is a second vertical bar 72. Bar 72 protrudes above the surface plane of strike plate 38 the same distance as bar 70, as shown in FIG. 4. The distance between bar 70 and bar 72 is such that an exterior bar surface 218 of bar 72 is substantially coplanar with the protruding edges of angle iron-shaped members 46 and 48. This is best shown in FIG. 4. The vertical extent of bar 72 is substantially equal to or slightly exceeds the vertical distance between upper and lower protruding member segments 52 and 56.

Strike plate 38 is mounted to lock-side door jamb 24 by rod 60, (see also FIG. 3) attached to the strike plate by welding along with nut 64, and at least four screws, one of which passes through hole 230. Dead bolt 122 (FIG. 10) is inserted into cut-out 232 in the interior plate-section 212. Of course, cut-out 232 must match and align with dead bolt 122 and the adjacent region of bolt plate 124.

The presence of vertical bar 70 limits access to the upper and lower edges of the lock security system. Bar 72 limits access to the interface between the door and the jamb as well as protects the lock security assembly from being attacked by a crow bar or other leverage means between door jamb 24 and the protruding member segments of upper and lower members 46 and 48.

Figure 12:
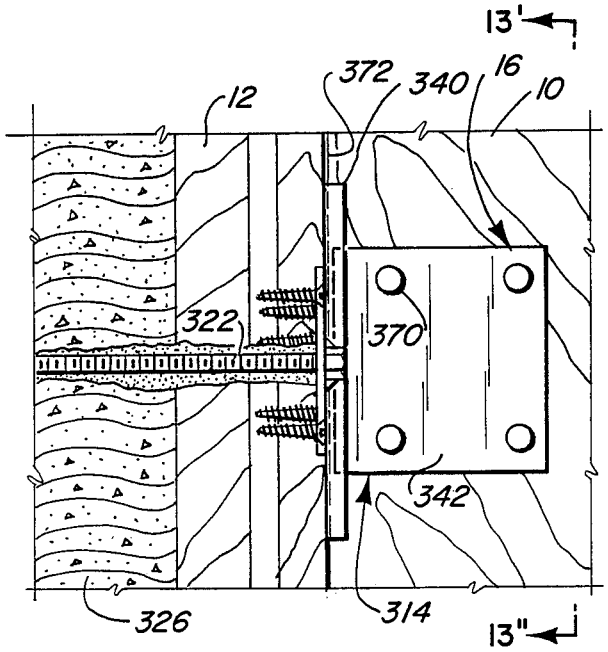
FIG. 12 illustrates a detailed view of the hinge assembly in accordance with the principles of the present invention.
Figure 13:
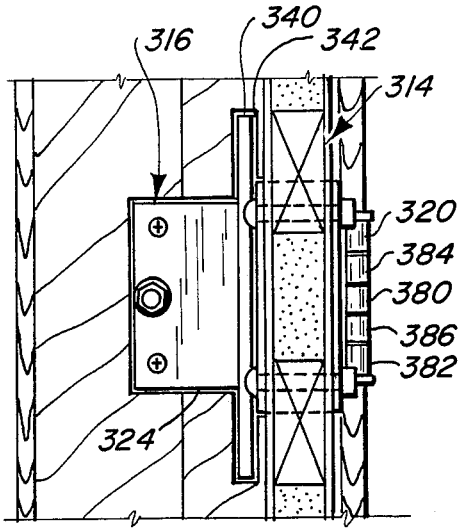
FIG. 13 illustrates a cross-sectional view of the hinge assembly and the door from the perspective of section line 13'-13" in FIG. 4.
Figure 14:
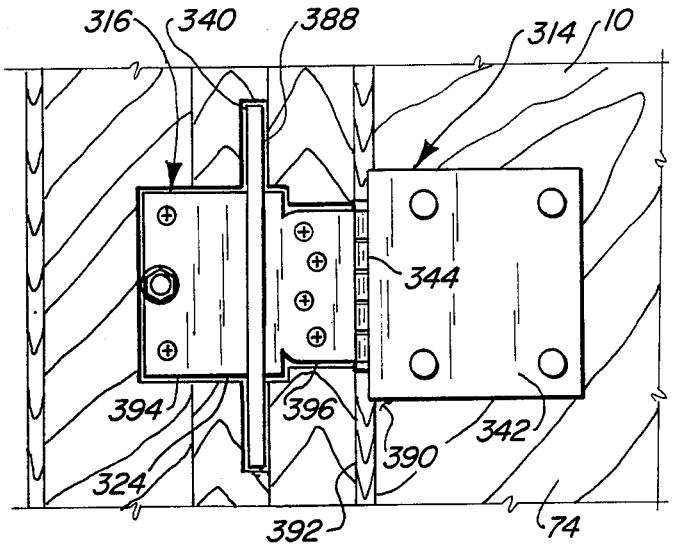
FIG. 14 illustrates a detailed view of the hinge assembly with the door open; and, FIG. 15 illustrates a detailed side view of a common door lock and handle as viewed towards the lock-side door surface.

The door hinge assemblies are shown in detail on the left-side of FIG. 4 and in FIGS. 12, 13 and 14. FIG. 4 shows door hinge assembly 16 mounted to door 10 via through bolts 310 and 312. The door hinge assembly includes a door hinge subassembly 314 and a jamb hinge subassembly 316. Door subassembly 314 and jamb subassembly 316 are joined together by a hinge pin 318 that extends through interleaved pin fittings, one of which is pin fitting 320, that are present on both subassemblies.

Jamb hinge subassembly 316 includes a rod 322 extending normal to a jamb plate 324. The jamb plate is mounted flush with door jamb 12. Further, rod 322 extends in an opposite direction away from door 10 normal to plate 324 and preferably is affixed to the concrete wall 326 of door jamb 12. Rod 322 is mounted to jamb plate 324 by a nut. Nut 328 is welded to the jamb plate along with the rod. This is very similar to the secured mounting of strike plate 38 on the opposite door jamb 24. Additionally, jamb plate 324 is mounted to door jamb 12 by a number of screws, one of which is screw 330.

Briefly, a vertical bar 340 is attached to jamb plate 324 such that a bar surface thereof is adjacent to exterior plate-section 342 of a cover plate that is part of door hinge subassembly 314. The cover plate is a wrap-around cover plate and covers an exterior surface portion of the door, a hinge-side door surface and an interior surface portion region of the door. These door surfaces are covered respectively by plate-section 342, plate-section 344 and plate-section 346. Hinge side plate-section 344 is shown as a double wall plate because the outside surface of plate-section 344 must be flush with the hinge-side door surface. Since the cover plate is larger than the standard door hinge, a cut-out is made in the cover plate and the door hinge is welded flush to the outside surface of plate-section 344. To better secure the door hinge, a second backing plate is added to the door hinge subassembly.

FIG. 12 shows a detail of hinge assembly 16. Particularly, FIG. 12 shows exterior plate-section 342 mounted to door 10 by screws that are placed into holes, one of which is hole 370. FIG. 12 also shows that hinge-side door surface 372 is very close to jamb 12. Further, the vertical extent of bar 340 is shown in FIG. 12. The bar extends above and below the upper and lower edges of exterior plate-section 342.

FIG. 13 is a cross-sectional end view of the door hinge assembly. The bar surface of vertical bar 340 is seen adjacent an extensive end region of exterior plate-section 342. Also, the interleaved pin fittings are shown in FIG. 13. Generally, alternating pin fittings are an integral part of door hinge subassembly 314 and jamb hinge subassembly 316. In one embodiment, the pin fittings 320, 380 and 382 are an integral part of the interior plate-section of jamb plate 324. On the other hand, pin fittings 384 and 386 are an integral part of an interior extension plate coplanar with hinge-side plate-section 344. As shown, these pin fittings are interleaved together and a hinge pin is placed through the cylindrical space formed by the fittings, thereby hanging the door on the door jamb.

FIG. 14 shows the hinge assembly when door 10 is open. Vertical bar 340 includes a bar surface 388 that is adjacent an end surface region 390 on exterior plate-section 342 when the door is closed. The flush mounting of plate-section 344 with hinge-side door surface 392 is shown.

Jamb plate 324 includes exterior plate-section 394 as well as interior plate-section 396. The interior and exterior plate-sections of jamb plate 324 are defined with respect to exterior door surface 74 when the door is closed.

The purpose of vertical bar 340 is to prevent access to interspace or interface between plate-section 344, of door hinge subassembly 314, and door surface 392. The integral cover plate, comprising plate-section 342, plate-section 344 and plate-section 346, strengthens the hinge that is normally simply screwed into the door along hinge-side door surface 392. The rod extending deep into door jamb 12 prevents the person seeking entry from simply destroying the jamb plate, bending or angularly displacing that plate thereby enabling access to the space between door hinge surface 392 and jamb 24.

Figure 15:
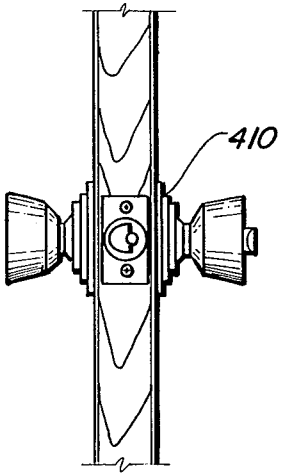

FIG. 15 shows common door lock 410 that is used in conjunction with the dead bolt lock described above.

The claims appended hereto are meant to cover modifications and changes within the scope and spirit of the present invention. For example, the security system could be made of a different material other than metal. Door 10 could be a steel rather than a wood door.

What I claim is:

1. A door security system to protect a lock on a door comprising:

a wraparound cover plate adapted to cover exterior and interior door surfaces adjacent the exterior and interior portions of said lock and covering a portion of the lock-side door surface around a bolt plate of said lock;

two pair of elongated angle iron-shaped members, one pair for the exterior and the other pair for the interior of said door, a longitudinal end of each member attached to a respective surface section of said cover plate and each pair forming upper and lower arms extending from said cover plate along the surface of said door with upper and lower protruding member segments facing each other;

a cylindrical collar circumferentially surrounding said exterior portion of said lock intermediate the corresponding upper and lower protruding member segments; and, means for mounting said cover plate and the attached arms to said door.

2. The lock security system as claimed in claim 1 wherein the extensive end of said collar protrudes from said exterior surface of said door less than the protruding edges of said upper and lower protruding member segments.

3. The lock security system as claimed in claim 2 wherein said lock includes a bolt cylinder, substantially intermediately spaced between said interior and exterior door surfaces, out of which is controllably adapted to project a dead bolt normal to said lock-side door surface, said bolt plate of said lock adapted to be mounted flush with said lock-side door surface, said bolt plate attached to said bolt cylinder and said dead bolt projecting normal from said bolt plate when said dead bolt is controllably moved outward, the security system:

wherein said cover plate has integral interior, exterior and lock-side plate-sections, the exterior and interior, upper and lower arm pairs respectively attached to upper and lower regions of said exterior and interior plate-sections, the security system including:

a bolt cylinder collar circumferentially surrounding said bolt cylinder and attached to the inside surface of said lock-side plate-section.

4. The lock security system as claimed in claim 1 wherein said cover plate has integral interior, exterior and lock-side plate-sections, the exterior and interior, upper and lower arm pairs respectively attached to upper and lower regions of said exterior and interior plate-sections.

5. The lock security system as claimed in claim 3 wherein said lock-side plate-section is adapted to be mounted flush with said lock-side door surface, and said lock-side plate-section includes a cut-out for mounting flush said bolt plate of said lock.

6. The lock security system as claimed in claim 5 wherein said bolt cylinder collar is attached to a secondary backing plate, and said secondary plate is substantially parallel to but spaced from said lock-side plate-section by a spacer, said lock-side plate-section, said spacer and said secondary plate all joined together.

7. The lock security system as claimed in claim 6 wherein the space between the planar surface of said lock-side plate-section and the planar surface of said secondary plate is substantially equal to the thickness of said bolt plate such that said bolt plate is adapted to seat on said secondary plate and be flush with said lock-side plate-section surface.

8. The lock security system as claimed in claim 1 wherein said each member has an inside plane surface that is parallel to and closely spaced to said exterior door surface, one longitudinal end region of said inside plane surface of said each member being attached to a corresponding cover plate surface section, the other longitudinal end region of said inside plane surface of respective pairs of said members being attached together by a joining plate.

9. The lock security system as claimed in claim 8 wherein the thickness of said joining plate equals the thickness of said cover plate.

10. The lock security system as claimed in claim 1 wherein said cover plate has integral interior, exterior and lock-side plate-sections, said interior and exterior plate-sections having cut-outs through which extends said lock, the interior and exterior portions of said lock being circumferentially larger than said plate-section cut-outs, and said collar for said exterior lock portion being circumferentially larger than said exterior lock portion.

11. The lock security system as claimed in claim 1 wherein said cover plate, members and collar are made of metal and are welded together.

12. The lock security system as claimed in claim 1 including:

a lock strike plate adapted to be mounted flush on a lock-side door jamb and normally extending through the exterior surface plane of said door, said strike plate having a first vertically extending bar mounted on said strike plate such that when said door is closed, one bar side of said first bar is adjacent a vertically extensive, exterior end surface section of said cover plate, and having a second vertically extending bar mounted on said strike plate such that when said door is closed an exterior bar surface of said second bar is substantially coplanar with the extensive protruding edges of said upper and lower arms mounted on the exterior of said door.

13. The lock security system as claimed in claim 11 wherein said strike plate includes a rod, normal to an outside surface plane of said strike plate and extending away from outside surface in an opposite direction from said lock-side door surface.

14. The lock security system as claimed in claim 1 wherein said arms extend horizontally across said door a distance exceeding one-half of the width of said door.

15. A door security system to protect a set of hinges upon which hang a door on a hinge-side door jamb comprising:

a plurality of hinge assemblies each including a door hinge subassembly and a jamb hinge subassembly;

said door hinge subassembly comprising:

a wraparound cover plate adapted to be mounted on and cover a portion of the exterior, interior and hinge-side door surfaces;

a first plurality of aligned, open ended, cylindrical hinge pin fittings disposed vertically along an extensive end surface of an extension plate that is coplanar with a hinge-side surface section of said cover plate and that extends through the interior surface plane of said door;

said jamb hinge assembly subassembly comprising:

a jamb plate adapted to be mounted flush on said hinge-side door jamb having an exterior section extending normal to the exterior surface plane of said door when said door is closed and an interior section coplanar to said exterior section and extending through said interior plane of said door;

a vertical bar affixed to said exterior section at a location such that, when said door is closed, a bar surface of said bar is adjacent a vertically extensive, exterior end surface region of said cover plate;

a second plurality of aligned, open ended, cylindrical hinge pin fittings disposed vertically along an interior, extensive end surface of said interior section of said jamb plate, said first and second pin fittings adapted to interleave together; and, said door hinge subassembly and said jamb hinge subassembly adapted to be journaled together by a hinge pin extending through the interleaved first and second pin fittings.

16. The door security system for hinges as claimed in claim 15 wherein said vertical bar extends above and below the upper and lower edges of both said exterior section of said jamb plate and an exterior plate-section of said cover plate.

17. The door security system for hinges as claimed in claim 15 wherein said jamb plate includes a rod, normal to said exterior section of said jamb plate and extending away from an outside surface of said exterior jamb plate-section in an opposite direction from said hinge-side door surface.

18. A door security system to protect a lock on a door, a lock strike plate adapted to be affixed to a lock-side door jamb and a set of hinges upon which hang said door on a hinge-side door jamb comprising:

a wraparound cover plate adapted to cover surface exterior and interior door surfaces adjacent the exterior and interior portions of said lock and covering a portion of the lock-side door surface around a bolt plate of said lock;

two pair of elongated angle iron-shaped members, one pair for the exterior and the other pair for the interior of said door, a longitudinal end of each member attached to a respective surface section of said cover plate and each pair forming upper and lower arms extending from said cover plate along the surface of said door with upper and lower protruding member segments facing each other;

a cylindrical collar circumferentially surrounding said exterior portion of said lock intermediate the corresponding upper and lower protruding member segments;

means for mounting said cover plate and the attached arms to said door;

a reinforced lock strike plate adapted to be mounted flush on said lock-side door jamb and extending through the exterior surface plane of said door, said strike plate having a first vertically extending bar mounted on said strike plate such that when said door is closed, one bar side of said first bar is adjacent a vertically extensive, exterior end surface section of said cover plate, and having a second vertically extending bar mounted on said strike plate such that when said door is closed an exterior bar surface of said second bar is substantially coplanar with the extensive protruding edges of said upper and lower arms mounted on the exterior of said door;

a plurality of hinge assemblies each including a door hinge subassembly and a jamb hinge subassembly;

said door hinge subassembly comprising:

a wraparound cover plate adapted to be mounted on and cover a portion of the exterior, interior and hinge-side door surfaces;

a first plurality of aligned, open ended, cylindrical hinge pin fittings disposed vertically along an extensive end surface of an extension plate that is coplanar with a hinge-side surface section of said cover plate and that extends through the interior surface plane of said door;

said jamb hinge subassembly comprising:

a jamb plate adapted to be mounted flush on said hinge-side door jamb and having an exterior section extending normal to the exterior surface plane of the closed door and an interior section coplanar to said exterior section and extending through said interior plane of said closed door;

a vertical bar affixed to said exterior section of said jamb plate at a location such that, when said door is closed, a bar surface thereof is adjacent a vertically extensive, exterior end surface region of said cover plate;

a second plurality of aligned, open ended, cylindrical hinge pin fittings disposed vertically along an interior, extensive end surface of said interior section of said jamb plate, said first and second pin fittings adapted to interleave together; and, said door hinge subassembly and said jamb hinge subassembly adapted to be journaled together by a hinge pin extending through the interleaved first and second pin fittings.

19. The door security system as claimed in claim 18 wherein said lock includes a bolt cylinder, substantially intermediately spaced between said interior and exterior door surfaces, out of which is controllably adapted to project a dead bolt normal to said lock-side door surface, said bolt plate of said lock adapted to be mounted flush with said lock-side door surface, said bolt plate attached to said bolt cylinder and said dead bolt projecting normal from said bolt plate when said dead bolt is controllably moved outward, the security system:

wherein said cover plate has integral interior, exterior and lock-side plate-sections, the exterior and interior, upper and lower arm pairs respectively attached to upper and lower regions of said exterior and interior plate-sections, the security system including:

a bolt cylinder collar circumferentially surrounding said bolt cylinder and attached to the inside surface of said lock-side plate-section.

20. The door security system as claimed in claim 19 wherein said each member has an inside plane surface that is parallel to and closely spaced to said exterior door surface, one longitudinal end region of said inside plane surface of said each member being attached to a corresponding cover plate surface section, the other longitudinal end region of said inside plane surface of respective pairs of said members being attached together by a joining plate.

21. The door security system as claimed in claim 20 wherein said arms extend horizontally across said door a distance exceeding one-half of the width of said door.

22. The door security system as claimed in claim 21 wherein said jamb plate includes a rod, normal to said exterior section of said jamb plate and extending away from an outside surface of said exterior section in an opposite direction from said hinge-side door surface.

23. The door security system as claimed in claim 22 wherein said strike plate includes a rod, normal to an outside surface plane of said strike plate and extending away from outside surface in an opposite direction from said lock-side door surface.

24. The door security system as claimed in claim 23 wherein all the components of said security system are metal.

* * * * *